US006257831B1

(12) United States Patent
Papple et al.

(10) Patent No.: US 6,257,831 B1
(45) Date of Patent: Jul. 10, 2001

(54) CAST AIRFOIL STRUCTURE WITH OPENINGS WHICH DO NOT REQUIRE PLUGGING

(75) Inventors: Michael Papple, Nun's Island (CA); William Abdel-Messeh, Rocky Hill, CT (US); Ian Tibbott, Lichfield (GB)

(73) Assignee: Pratt & whitney Canada Corp., Longueuil (CA)

( * ) Notice: Subject to any disclaimer, the term of this patent is extended or adjusted under 35 U.S.C. 154(b) by 0 days.

(21) Appl. No.: 09/425,175

(22) Filed: Oct. 22, 1999

(51) Int. Cl.[7] ..... F01D 5/18
(52) U.S. Cl. ..... 416/97 R
(58) Field of Search ..... 415/115; 416/95, 416/97 R; 164/122.1, 122.2, 369

(56) References Cited

U.S. PATENT DOCUMENTS

| | | | | |
|---|---|---|---|---|
| 2,566,928 | | 9/1951 | Carter . | |
| 3,527,543 | | 9/1970 | Howald . | |
| 3,528,751 | | 9/1970 | Quinones et al. . | |
| 3,533,711 | | 10/1970 | Kercher . | |
| 3,706,508 | | 12/1972 | Moskowitz et al. . | |
| 3,801,218 | | 4/1974 | Moore . | |
| 3,982,851 | * | 9/1976 | Andersen et al. | 416/92 |
| 4,073,599 | * | 2/1978 | Allen et al. | 416/97 R |
| 4,180,373 | | 12/1979 | Moore et al. . | |
| 4,278,400 | * | 7/1981 | Yamarik et al. | 416/97 R |
| 4,416,585 | | 11/1983 | Abdel-Messeh . | |
| 4,434,835 | | 3/1984 | Willgoose . | |
| 4,456,428 | | 6/1984 | Cuvillier . | |
| 4,474,532 | | 10/1984 | Pazder . | |
| 4,514,144 | | 4/1985 | Lee . | |
| 4,515,526 | | 5/1985 | Levengood . | |
| 4,604,031 | * | 8/1986 | Moss et al. | 416/97 R |
| 4,638,628 | | 1/1987 | Rice . | |
| 4,770,608 | | 9/1988 | Anderson et al. . | |
| 4,786,233 | | 11/1988 | Shizuya et al. . | |
| 5,052,889 | | 10/1991 | Abdel-Messeh . | |
| 5,326,224 | | 7/1994 | Lee et al. . | |
| 5,342,172 | | 8/1994 | Coudray et al. . | |
| 5,462,405 | | 10/1995 | Hoff et al. . | |
| 5,465,780 | | 11/1995 | Muntner et al. . | |
| 5,486,093 | | 1/1996 | Auxier et al. . | |

FOREIGN PATENT DOCUMENTS

| | | |
|---|---|---|
| 34961 | 9/1981 | (EP) . |
| 0 835 985 | 4/1998 | (EP) . |
| 1355558 | 6/1974 | (GB) . |
| 1410014 | 10/1975 | (GB) . |
| 1 471 963 | 4/1977 | (GB) . |
| 2 078 596 | 11/1982 | (GB) . |
| 2112467 | 7/1983 | (GB) . |
| 0001804 | 7/1986 | (JP) . |

* cited by examiner

*Primary Examiner*—Edward K. Look
*Assistant Examiner*—Ninh Nguyen
(74) *Attorney, Agent, or Firm*—Jeffrey W. Astle

(57) ABSTRACT

A cooled gas turbine engine airfoil comprises a flow deflector arrangement adapted to re-direct a cooling fluid away from an unfilled opening left by a support member of a casting core used during the casting of the airfoil. The provision of the flow deflector arrangement advantageously allows for a larger core support, thereby facilitating the manufacture of the airfoil.

15 Claims, 4 Drawing Sheets

CAST AIRFOIL STRUCTURE WITH OPENINGS WHICH DO NOT REQUIRE PLUGGING

BACKGROUND OF THE INVENTION

1. Field of the Invention

The present invention relates to manufacturing of airfoil structures suited for gas turbine engines and, more particularly, to a new cast hollow airfoil structure with openings which do not require plugging.

2. Description of the Prior Art

Gas turbine engine airfoils, such as gas turbine blades and vanes, may be provided with an internal cavity defining cooling passageways through which cooling air can be circulated. By cooling these airfoils, they can be used in an engine environment which is hotter than the melting point of the airfoil metal.

Typically, the internal passages are created by casting with a solid, ceramic core which is later removed by well known techniques, such as dissolving techniques.

The core forms the inner surface and tip cavity of the hollow airfoil, while a mold shell forms the outer surface of the airfoil. During the casting process, molten metal fills the space between the core and the shell mold. After this molten metal solidifies, the mold shell and the core are removed, leaving a hollow metal structure.

The region of the core which later forms the tip cavity is connected to the main body of the core by tip supports. These tip supports later form the tip openings in the metal airfoil.

The casting core must be accurately positioned and supported with the mold shell in order to ensure dimensional precision of the cast product. The core is held within the shell mold by the regions of the core which later form the passage through the fixing, the trailing edge exit slots, and the tip cavity. The core is rigidly held at these extremities. During the casting process in which molten metal is poured around the core, a significant force is exerted on the core which may break the tip supports.

In order to minimize the manufacturing cost of each airfoil, the tip supports should be sufficiently large to avoid breakage during the casting process. It is also necessary to minimize the quantity of coolant air which exits the airfoil tip openings, in order to preserve the overall gas turbine engine performance.

It is possible to cast large tip openings, then plug these openings using a welding, brazing or similar process, however there would be an extra cost associated with this additional process.

Accordingly, there is a need for a new internal structure for gas turbine engine airfoils which allows for improved strength of the core during the casting process, without requiring plugging of tip openings.

SUMMARY OF THE INVENTION

It is therefore an aim of the present invention to improve the strength of a casting core used in the manufacturing of an airfoil suited for a gas turbine engine.

It is also an aim of the present invention to facilitate the manufacturing of an airfoil for a gas turbine engine.

It is also an aim of the present invention to provide a new and improved casting core for an airfoil.

It is still a further aim of the present invention to provide a cast airfoil having a new internal design allowing for relatively large core support members to be used during the casting process, while restricting the quality of cooling fluid which passes through the resulting opening when the cast airfoil is assembled in a gas turbine engine.

Therefore, in accordance with the present invention, there is provided a cooled airfoil for a gas turbine engine, comprising a body defining an internal cooling passage for passing a cooling fluid therethrough to convectively cool the airfoil, at least one opening left by a support member of a casting core used during casting of the airfoil. The opening extends through the body and is in flow communication with the internal cooling passage. At least one flow deflector is provided within the body for deflecting a desired quantity of cooling fluid away from the opening.

According to a further general aspect of the present invention, there is provided a casting core for use in the manufacturing of a hollow gas turbine engine airfoil, comprising a main portion adapted to be used for forming the internal geometry of an airfoil having at least one internal cooling passage through which a cooling fluid can be circulated to convectively cool the airfoil, at least one point of support on the main portion, the point of support resulting in an opening through the airfoil, and wherein the main airfoil portion is provided with flow deflector casting means to provide a flow deflector arrangement within the internal cooling passage to direct a selected quantity of the cooling flow away from the opening while the airfoil is being used.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
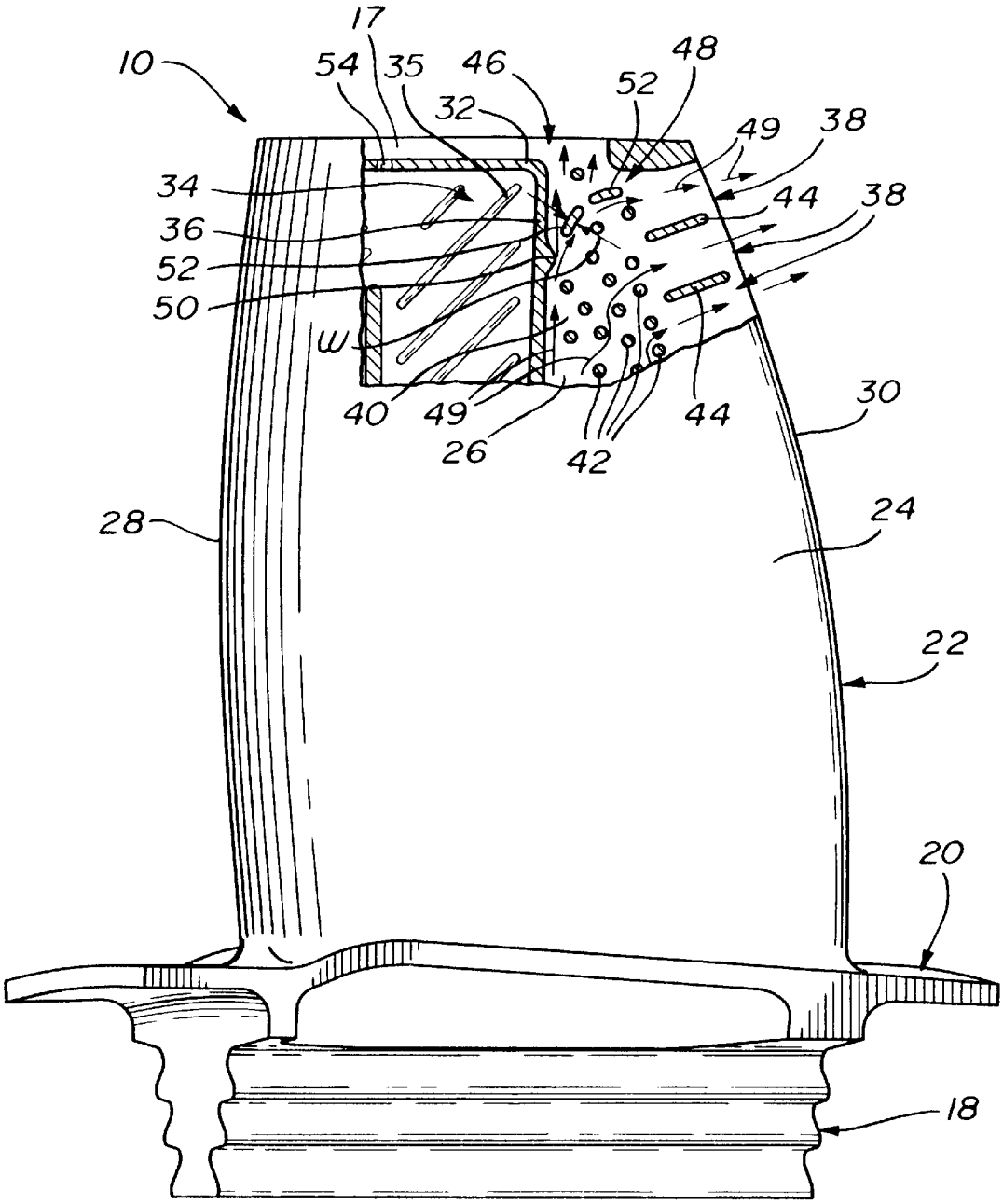
FIG. 1 is a partly broken away longitudinal sectional view of a hollow gas turbine blade in accordance with a first embodiment of the present invention.
Figure 3:
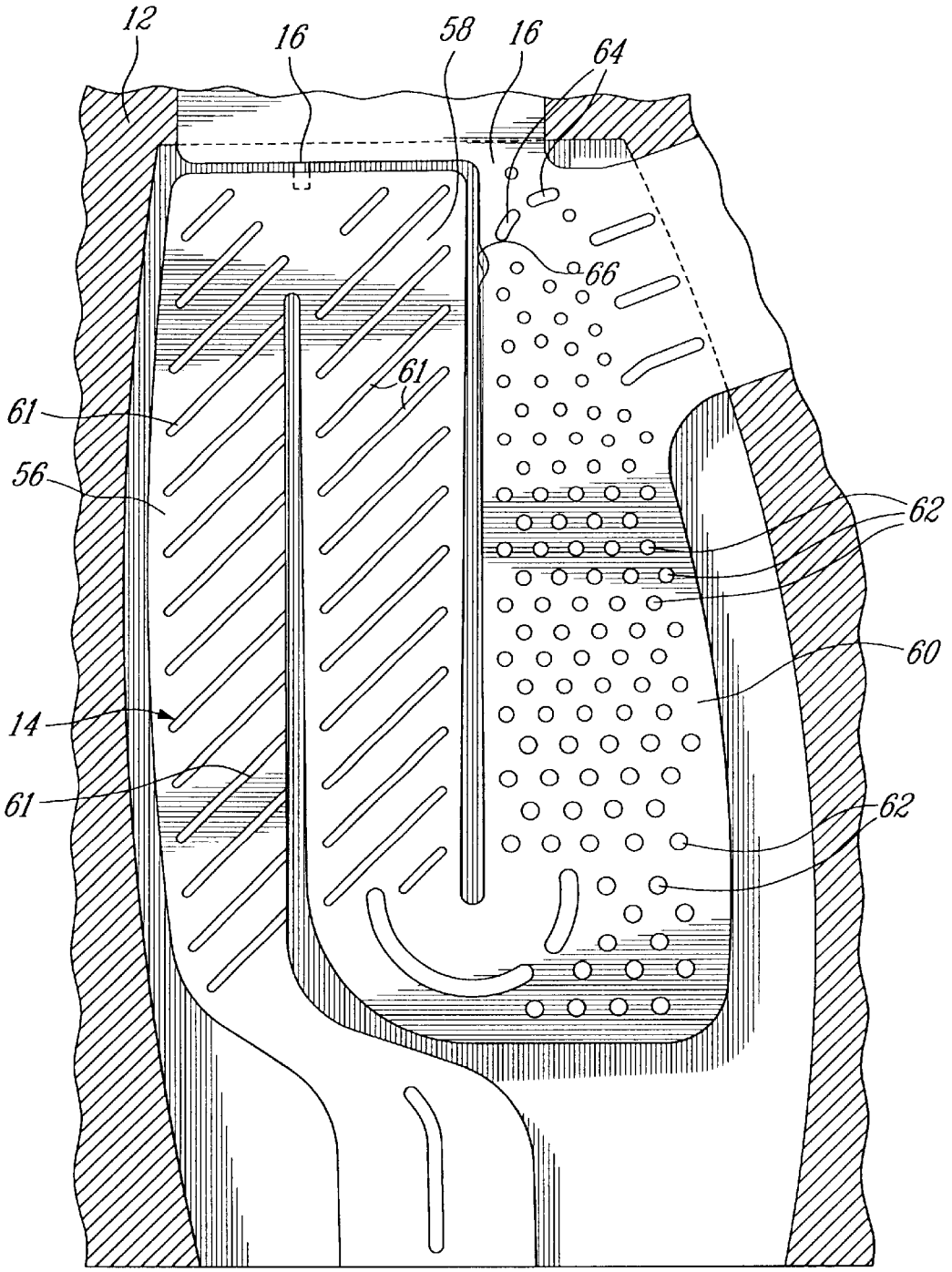
FIG. 3 is a schematic plan view of a casting core supported in position within a mold.
Figure 4:
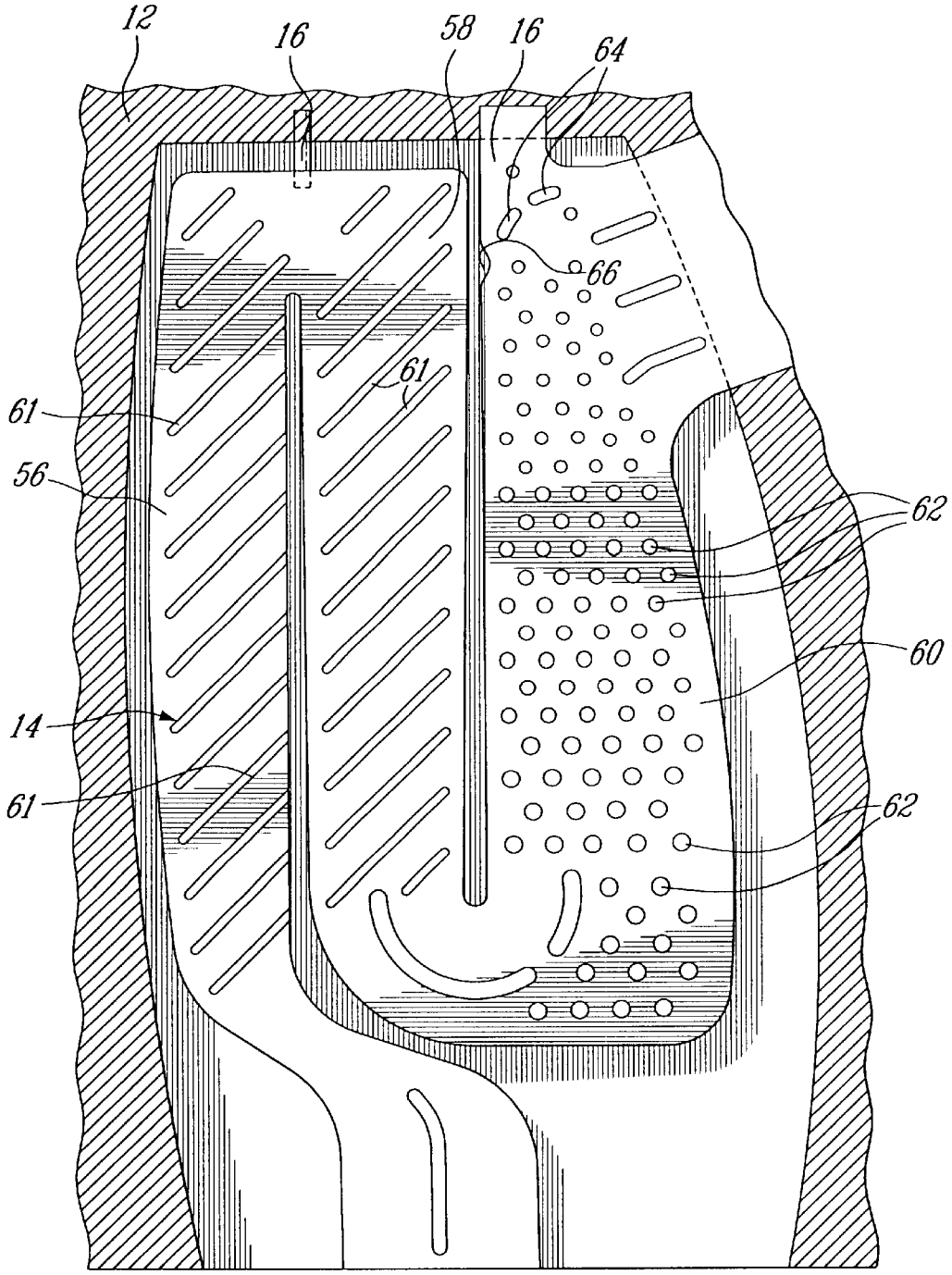
FIG. 4 is a schematic plan view of a casting core supported in position within a mold in accordance with a further embodiment of the present invention.

Referring now to FIG. 1, there is shown a gas turbine engine blade 10 made by a casting process. As is well known in the art, such casting is effected by pouring a molten material within a mold 12 (a portion of which is shown in FIG. 3) about a core 14 supported in position within the mold 12 by means of a number of pins or supports 16 extending from the main body of the core 14 to the mold 12 (see FIG. 4), or alternatively, from the main body of the core 14 to the part of the core which forms the tip cavity 17 (see FIG. 3). The geometry of the mold 12 reflects the general shape of the outer surface of the blade 10, whereas the geometry of the core 14 reflects the internal structure geometry of the blade 10. Actually, the core 14 is the inverse of the internal structure of the airfoil 10. After casting, the core 14 is removed by an appropriate core removal technique, leaving a hollow core-shaped internal cavity within the cast blade 10.

As seen in FIG. 1, the cast blade 10 more specifically comprises a root section 18, a platform section 20 and an airfoil section 22. The root section 18 is adapted for attachment to a conventional turbine rotor disc (not shown). The platform section 20 defines the radially innermost wall of the flow passage (not shown) through which the products of combustion emanating from a combustor (not shown) of the gas turbine engine flow.

The airfoil section 22 comprises a pressure side wall 24 and a suction side wall 26 extending longitudinally away from the platform section 20. The pressure and suction side walls 24 and 26 are joined together at a longitudinal leading edge 28, a longitudinal trailing edge 30 and at a transversal tip wall 32. A conventional internal cooling passageway 34, a portion of which is shown in FIG. 1, extends in a serpentine manner from the leading edge 28 to the trailing edge 30 between the pressure side wall 24 and the suction side wall 26. The various segments of the internal cooling passageway 34 are in part delimited by a number of longitudinal partition walls, such as at 36, extending between the pressure side wall 24 and the suction side wall 26. In a manner well known in the art, a cooling fluid, such as compressor bleed air, is channeled into the passageway 34 via a supply passage (not shown) extending through the root section 18 of the blade 10. The cooling fluid flows in a serpentine fashion through the internal cooling passageway 34 so as to cool the blade 10 before being partly discharged through exhaust ports 38 defined in the trailing edge area of the blade 10. A plurality of trip strips 35 are typically provided on respective inner surfaces of the pressure and suction side walls 24 and 26 to promote heat transfer from the blade 10 to the cooling fluid.

As seen in FIG. 1, the internal cooling passageway 34 includes a trailing edge cooling passage segment 40 in which a plurality of spaced-apart cylindrical pedestals 42 extend from the pressure side wall 24 to the suction side wall 26 of the blade 10 in order to promote heat transfer from the blade 10 to the cooling fluid. The exhaust ports 38 near the tip end wall 32 of the blade 10 are provided in the form of a series of slots separated by partition walls 44 oriented at an angle with respect to the longitudinal axis of the trailing edge cooling passage segment 40. The partition walls 44 extend from the pressure side wall 24 to the suction side wall 26.

An opening 46 left by one of the supports 16 used to support the core 14 during the casting of the blade 10 extends through the tip end wall 32 in proximity with the trailing edge 30. Instead of filling or plugging the opening 46 as it is the case with conventional gas turbine blades, a new flow deflector arrangement 48 is provided within the trailing edge cooling passage segment 40 to smoothly re-direct the flow from a longitudinal direction to a transversal direction towards the exhaust ports 38, as depicted by arrows 49.

According to the illustrated embodiment, the flow deflector arrangement 48 comprises a half pedestal 50 and a pair of curved vanes or walls 52 arranged in series upstream of the opening 46 to deflect a desired quantity of cooling fluid towards the exhaust ports 38. For example, 80% of the flow may be discharged through the exhaust ports 38 with only 20% flowing through the opening 46. It is noted that the quantity of cooling fluid flowing through the opening 46 must be kept as low as possible in order to preserve the overall gas turbine engine performance.

As seen in FIG. 1, the half pedestal 50 may extend from the partition wall 36 between the pressure side wall 24 and the suction side wall 26. The curved vanes 52 extend from the pressure side wall 24 to the suction side wall 26. The half pedestal 50 and the curved vanes 52 are distributed along a curved line to cooperate in re-directing the flow of cooling fluid towards the exhaust ports 38. The half pedestal 50 causes the cooling fluid flowing along the partition wall 36 to move away therefrom. The curved vanes 52 continue to guide the desired quantity of cooling fluid away from the opening 46 and towards the exhaust ports 38.

The half pedestal 50 and the curved vanes 52 may be of uniform or non-uniform dimensions. For instance, the curved vanes 52 could have a variable width (w).

It is understood that other suitable flow deflector arrangements could also be provided, as long as they adequately direct the desired amount of cooling fluid towards the exhaust ports 38. For instance, the curved vanes 52 could be replaced by straight vanes properly oriented in front of the opening 46. Furthermore, it is understood that the half pedestal 50 and the curved vanes 52 do not necessarily have to extend from the pressure side wall 24 to the suction side wall 26 but could rather be spaced from one of the pressure and suction side walls 24 and 26.

Figure 2:
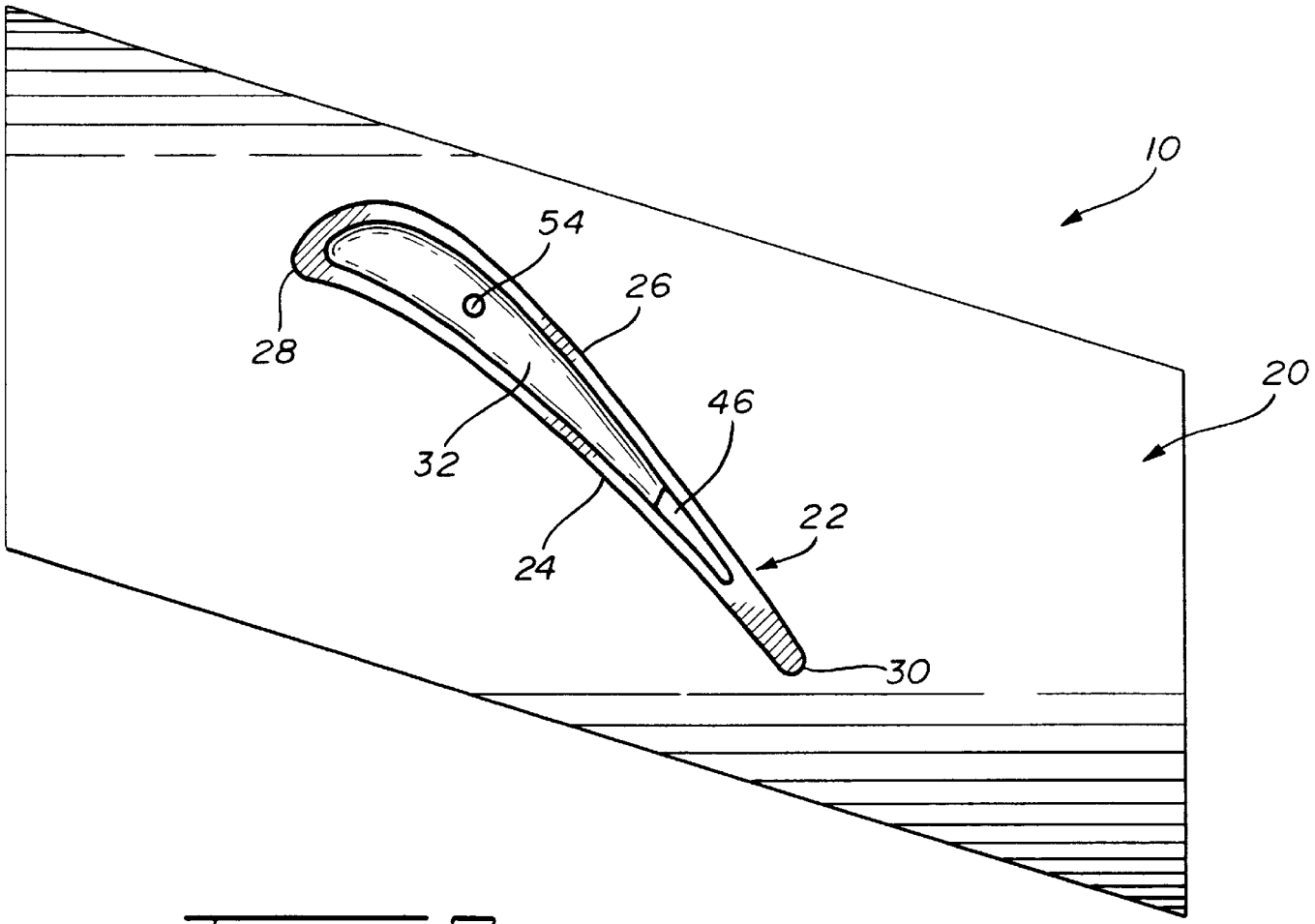
FIG. 2 is an end view of the hollow gas turbine blade of FIG. 1.

It is also understood that a flow deflector arrangement could be provided for each opening left by the supports 16. For instance, a second flow deflector arrangement could be provided within the blade 10 for controlling the amount of cooling fluid flowing, for instance, through a second opening 54 extending through the front portion of the tip wall 32, as seen in FIGS. 1 and 2.

One benefit of using a flow deflector arrangement as described hereinbefore resides in the fact that larger supports 16 can be used to support the main body of the core 14 within the mold shell 12 (see FIG. 4), or alternatively, the main body of the core 14 with the part thereof forming the tip cavity 17 (see FIG. 3), thereby providing for precise and accurate shaping and dimensioning of the internal structure of the cast blade 10. Furthermore, it has been found that the provision of internal flow deflector arrangements, which eliminate the need of filling the openings left by the supports 16, contributes to reduce the manufacturing cost of the blade 10.

As seen in FIG. 3, the geometry of the core 14 determines the internal geometry of the cast blade 10. The core 14 is formed of a series of laterally spaced-apart fingers 56, 58 and 60 interconnected in a serpentine manner reflecting the serpentine nature of the resulting internal cooling passageway 34. The peripheral surface of the core 14 against which the inner surface of the pressure and suction side walls 24 and 26 will be formed defines a plurality of grooves 61 within which the trip strips (designated by reference numeral 35 in FIG. 1) will be formed. A plurality of holes 62 are also defined through the core 14 for allowing the formation of the pedestals 42. A pair of spaced-apart curved slots 64 are defined through the core 14 at the aft tip end thereof in front of the aft tip point of support of the core 14 to provide the curved vanes 52 in the final product. Finally, an elongated groove 66 is defined in a peripheral portion of finger 60 to form the half pedestal 50 in the cast blade 10. The core 14 may be made of ceramic or any suitable material.

It is understood that the above described invention is not limited to the manufacture of gas turbine blades and the cores thereof. For instance, it could be applied to gas turbine vanes or the like.

What is claimed is:

1. A cooled airfoil for a gas turbine engine, comprising a body defining an internal cooling passage for passing a cooling fluid therethrough to convectively cool said airfoil, at least one opening left by a support member of a casting core used during casting of said airfoil, said opening extending through said body and being in flow communication with said internal cooling passage, and at least one flow deflector provided within said body in proximity to said opening for restricting cooling flow therethrough.

2. A cooled airfoil as defined in claim 1, wherein said body has longitudinal leading and trailing edges extending to a transversal tip end, and wherein said opening is defined through said tip end in proximity of said trailing edge.

3. A cooled airfoil as defined in claim 2, wherein a plurality of exhaust ports are defined through said trailing edge for allowing the cooling fluid to flow out of said airfoil, and wherein said at least one flow deflector is arranged to guide the cooling fluid towards said exhaust ports.

4. A cooled airfoil as defined in claim 3, wherein said internal cooling passage comprises a trailing edge cooling passage segment, and wherein said at least one flow deflector is disposed within said trailing edge cooling passage segment in front of said opening.

5. A cooled airfoil as defined in claim 4, wherein said at least one flow deflector comprises a series of spaced-apart deflectors.

6. A cooled airfoil as defined in claim 5, wherein at least some of said spaced-apart deflectors are curved.

7. A cooled airfoil as defined in claim 5, wherein said spaced-apart flow deflectors each extend from a first wall to a second opposed wall of said body.

8. A cooled airfoil as defined in claim 7, wherein said spaced-apart deflectors are selected from a group consisting of: pedestals, half-pedestals, curved and straight vanes.

9. A cooled airfoil as defined in claim 1, wherein about 20% of the cooling fluid flows through said opening.

10. A cooled airfoil as defined in claim 1, wherein said at least one flow deflector comprises a series of spaced-apart deflectors distributed along a curved line.

11. A casting core for used in the manufacturing of a hollow gas turbine engine airfoil, comprising a main portion adapted to be used for forming the internal geometry of an airfoil having at least one internal cooling passage through which a cooling fluid can be circulated to convectively cool the airfoil, at least one point of support on said main portion, said point of support resulting in an opening through the airfoil, and wherein said main airfoil portion is provided with flow deflector casting means to provide a flow deflector arrangement within said internal cooling passage to direct a selected quantity of the cooling flow away from said opening while the airfoil is being used, wherein said flow detector casting means include a number of cavities extending through said main portion in proximity of said point of support.

12. A casting core as defined in claim 11, wherein said flow deflector casting means further include an elongated peripheral groove having a longitudinal axis which is parallel to respective longitudinal axes of said cavities.

13. A casting core as defined in claim 12, wherein said cavities are slotted holes and said elongated peripheral groove are distributed along a curved lines.

14. A casting core as defined in claim 13, wherein said slotted holes are curved.

15. A cooled airfoil for a gas turbine engine, comprising a body defining an internal cooling passage for passing a cooling fluid therethrough to convectively cool said airfoil, at least one opening left by a support member of a casting core used during casting of said airfoil, said opening extending through said body and being in flow communication with said internal cooling passage, and at least one flow deflector provided within said body for deflecting a desired quantity of cooling fluid away from said opening, wherein about 20% of the cooling fluid flows through said opening.

* * * * *